United States Patent [19]

Krüger

[11] Patent Number: 4,629,281

[45] Date of Patent: Dec. 16, 1986

[54] ELECTRIC CONNECTOR FOR COATED PRINTED CIRCUIT BOARDS

[75] Inventor: Peter Krüger, Detmold, Fed. Rep. of Germany

[73] Assignee: C. A. Weidmüller GmbH & Co., Detmold, Fed. Rep. of Germany

[21] Appl. No.: 715,642

[22] Filed: Mar. 21, 1985

[30] Foreign Application Priority Data

Apr. 3, 1984 [DE] Fed. Rep. of Germany ..... 3412317

[51] Int. Cl.[4] ..... H01R 4/36

[52] U.S. Cl. ..... 339/272 R; 339/17 LC

[58] Field of Search ..... 339/17 C, 263 R, 263 L, 339/272 R, 272 B, 272 UC, 176 MP, 17 LC

[56] References Cited

U.S. PATENT DOCUMENTS 4,464,010 8/1984 Grossman et al. ..... 339/272 R

FOREIGN PATENT DOCUMENTS 1026840 2/1978 Canada ..... 339/272 R
1107753 5/1961 Fed. Rep. of Germany ... 339/272 R
2331761 1/1975 Fed. Rep. of Germany ... 339/272 R
3208065 9/1983 Fed. Rep. of Germany .

*Primary Examiner*—Gil Weidenfeld
*Assistant Examiner*—Gary F. Paumen
*Attorney, Agent, or Firm*—Michael J. Striker

[57] ABSTRACT

In a connector for printed circuit board a traction yoke is a frame in which two parallel contact plates are positioned. The contact plates are mechanically and electrically combined in a single contact piece which can be rotated about a clamping bolt received in the contact piece and clamping the connector to the printed circuit board.

13 Claims, 5 Drawing Figures

ELECTRIC CONNECTOR FOR COATED PRINTED CIRCUIT BOARDS

BACKGROUND OF THE INVENTION

The present invention relates to electric connectors for printed circuit boards.

An electric connector of the foregoing type includes a yoke to be pulled on the edge of the printed circuit board to engage the latter, two contact plates positioned in the yoke and overlapping the upper and lower sides of the printed circuit board, respectively, and a clamping bolt received in the yoke.

One of such connectors is described in German publication DE-OS No. 3,208,065. The edge of the printed circuit board, receiving the connector is provided with two slots so that the yoke of the connector would be inserted into these slots. The contact plates are releasably inserted into the frame-shaped yoke. The upper contact plate is loaded at the upper side with the clamping bolt. The contact plates have laterally extending tongues which mechanically engage at the slots of the printed circuit board, and forces, which act normally to the plane of the printed circuit board, can be taken up.

In this known connector both contact plates are releasable from the frame-shaped yoke and can, as well as the clamping bolt, be removed from the yoke, without percussions, during the transportation.

The assembly of the connector on the printed circuit board as well as fastening of a lead in the connector have been always problematic. For assembling on the printed circuit board not only the yoke should be mounted in the slots of the printed circuit board but also both contact plates must be held one on the other to enable the board portion between two slots to receive the contact plates. Faulty assembling, at which both contact plates could be inadvertently placed either on the upper side or the lower side of the printed circuit board, can occur. A preassembling of the connector with the printed circuit board is possible mostly in a closed or clamped position because otherwise the connector might fall from the printed circuit board. For connecting a lead to the connector a user should in each case to open the connector and watch that the connector would not be separated from the pointed circuit board. In addition to that a user should hold the lower contact plate in order to insert the lead between the lower contact plate and the bottom of the yoke because the lower contact plate loosely guided in the yoke can any time drop.

Electric conductors as known in the art are often design for conducting considerably high power currents, and are normally connected to the electric paths on the upper side and the lower side of the printed circuit board at the same time. Through contacts, which can be provided on the printed circuit board, result in very small conductive areas. Usually in conventional connectors the upper and lower contact plates have an electric contact with one another via the pulling yoke. This yoke is, however, made of non-well-conductive material so that electrical connection between the upper side and the lower side of the printed circuit board is unsatisfactory.

SUMMARY OF THE INVENTION

It is an object of the present invention to provide an improved electric connector.

It is another object of this invention to provide a connector which is easy to assemble and which ensures good conductivity between the upper side and the lower side of the printed circuit board.

These and other objects of the invention are attained by a connector for electroplated printed circuit boards, comprising a traction yoke; two contact plates positioned in said yoke and engageable with an upper side and a lower side of a printed circuit board at an edge thereof; and a clamping bolt acting on said contact plates to clamp a lead to be connected to the printed circuit board; said contact plates being mechanically and electrically connected to each other so as to form a single contact piece, said contact piece being freely rotatable relative to said clamping bolt.

Due to the invention both contact plates are continually positioned at a predetermined distance from each other, which ensures that the edge portion of the printed circuit board is received between the plates. The contact plates can not fall from the printed circuit board and together with the clamping bolt form a non-loosable unit because the clamping bolt, connected to the contact piece or the contact plates so that the contact piece can rotate about the clamping bolt in a non-clamped position, can not itself be easily lost. By the rotation of the clamping bolt to an open or non-clamped position the yoke is also placed in the open position and is ready to receive a conductor to be connected to the printed circuit board because it is not necessary to additionally hold the lower contact plate which is an integral portion of the contact piece. The combining of both contact plates into a single contact piece ensures each time a sufficient area of an electrical connection between two contact plates and thereby between the upper side and the lower side of the printed circuit board.

The contact plates may be connected to each other by a cross-piece and formed of a stamped and bent plate. Thus the contact piece can be easily manufactured.

The contact piece at an upper one of said contact plates may be provided with a connection portion which is formed with a locking recess receiving said clamping bolt in assembly.

The contact piece may be a stamped element, said connection portion being bent over from a free outer edge of said upper plate.

The contact plates are parallel to each other and may be spaced from each other by a distance, said distance and a material of said contact piece being selected so that the contact piece is resiliently clamped on said printed circuit board at a predetermined position.

When electroplated printed circuit boards, having slots at edges thereof, are utilized the traction yoke or clamp is formed as a frame or cage and the contact plates have tongues or projections laterally outwardly extending from the yoke. In this case the locking recess is elongated and its elongation may be directed at an angle of 90° relative to a direction of insertion of the contact plates on the printed circuit board. In this case the contact piece is easily placed onto the edge portion of the printed circuit board with the clamping bolt connected thereto and the connector can be easily clamped on the board.

In case of the printed circuit boards, which have no slots at their edge portions, the yoke may have at a side thereof, facing said edge a recess receiving said contact piece. Due to this recess the connector can be engaged with the edge of the printed circuit board at all desired locations.

The clamping bolt may have a circular recess at which the clamping bolt is connected to the contact piece, said contact piece being rotatable about said bolt at said recess.

The connector may include an additional connecting means provided in said yoke for connecting a conductor thereto. This additional connecting means may include a clamping bolt carrying an additional yoke.

The connector according to this invention can have all functions of a preliminary assembly of the printed circuit board. Such connectors can be secured to the printed circuit boards without damaging the latter and at any predetermined locations. Faulty positionings of such connectors on the printed circuit boards are prevented. The clamping of the such connectors to printed circuit boards is no longer troublesome for a user. The user merely inserts a lead or conductor into the yoke in the region of the contact piece and fastens the conductor in the yoke.

The contact plates have sides facing said printed circuit board in an inserted position, said sides may be formed with locking cams, said board having arresting recesses receiving said cams in an inserted position of the connector.

The sides of the contact plates may have locking teeth which produce grooves in said board in an inserted position of the connector.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figures 1, 1A:
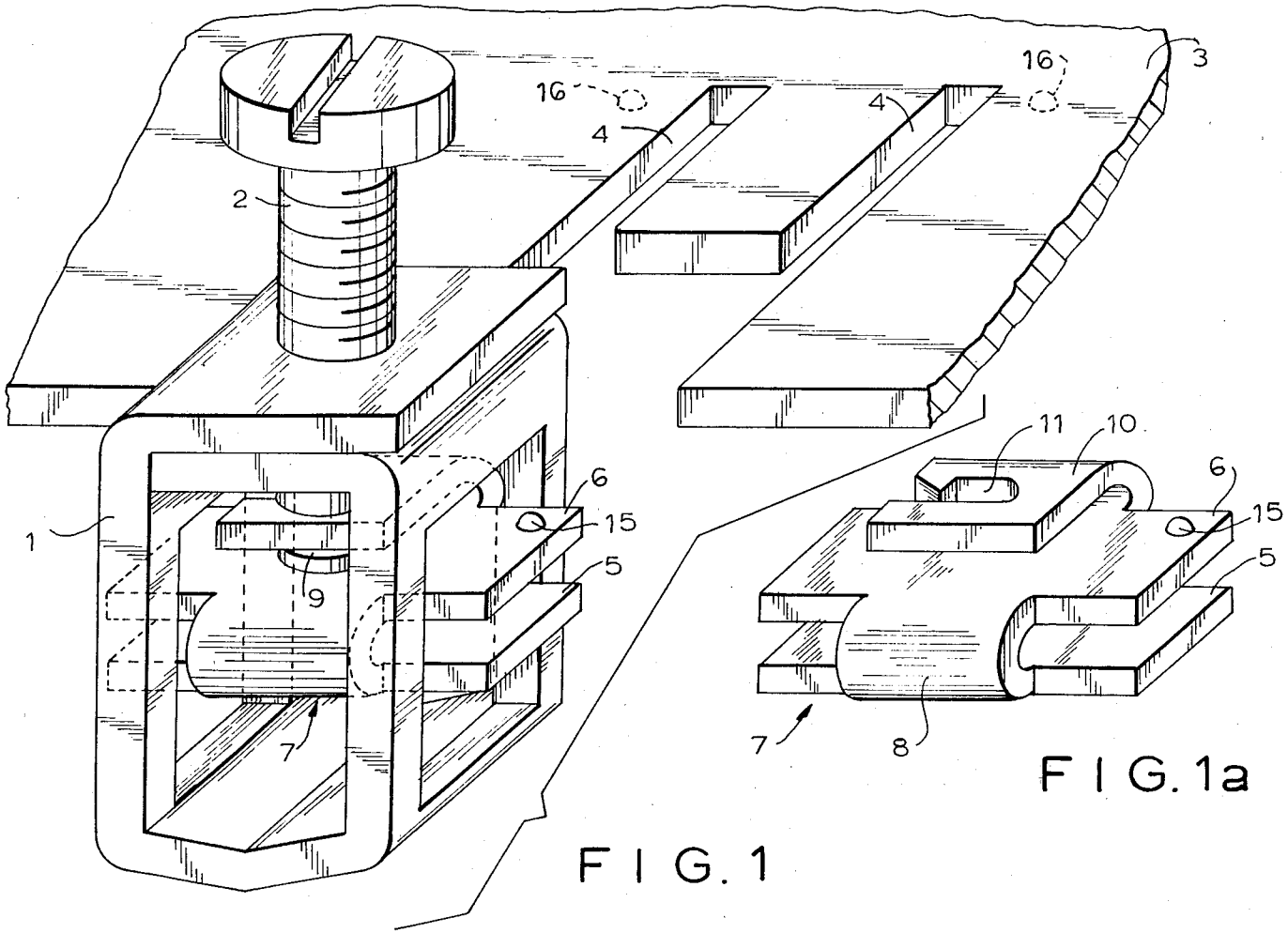
FIG. 1 is an exploded perspective view of a connector according to the invention.
FIG. 1*a* is a perspective view of the contact element.

Referring now to the drawings in detail, and first to FIG. 1 thereof, it will be seen that the connector for printed circuit boards according to the invention includes a traction or pulling clamp or yoke 1 which has the shape of a closed hollow cage recessed at four lateral sides, and receives at the upper side thereof a clamping bolt 2 threaded therein. The electroplated printed circuit board has in the area of its edge two parallel slots 4 in which the pulling yoke can be inserted and the connector can be received. The electric connector further includes two parallel contact plates 5 and 6 which are mechanically and electrically connected into a single contact piece or element 7 which is formed as one-piece with contact plates 5 and 6. In this embodiment both parallel contact plates 5 and 6 are interconnected by a connection web 8 extended between two edges of plates 5 and 6. The contact element 7 is freely rotationally connected to a lower end of the clamping bolt 2. For this purpose the clamping bolt 2 has at its lower end a circular recess 9 which receives a connection portion 10 provided on the contact or pressure element 7. An arresting opening or recess 11 is in turn formed in the connection portion 10; opening 11 receives the lower end of the clamping bolt 2. The connection portion 10 bent over from the free edge region of the upper contact plate 6 is formed in one piece with contact element 7. The entire pressure element 7, including its connection portion 10, can be preferably manufactured as one piece by stamping out and then bent into its final shape.

The opening -and-insertion direction of the arresting recess 11 in the connection portion 10 extends at the angle of 90° to the opening-and-insertion direction of both contact plates 5 and 6 relative to a printed circuit board 3. The pressure element 7 can be inserted into the pulling yoke 1 in a simple manner from the lateral side of the yoke and can be there locked with the lower end of clamping bolt 2.

During the manufacturing of the pressure element the distance between two contact plates 5 and 6 and the electrically conductive material for the pressure element as well as its elastic properties are so selected that they must be sufficient so that the electric connector as a whole would be elastically clamped in the direction of assembling at the corresponding edge region of the printed circuit board 3, and due to the elastic clamping action of both contact plates 5 and 6, would be preliminarily sufficiently steadily held on the printed circuit board 3. Both contact plates 5 and 6 have laterally projecting portions so that, upon the insertion of the yoke into slots 4, these projecting portions mechanically bridge or overlap the upper side and the lower side of the printed circuit board.

The electrical paths on the upper side and the lower side of the printed circuit board 3 are reliably electrically connected to each other by means of the connecting crosspiece 8.

Due to a screened shape the connector of this invention in an open or removed position as shown in FIG. 1 can be inserted into slots 4 of the printed circuit board 3 and there assembled. It is sufficient for a user to insert the lead into the lower region of traction yoke 1 under the lower contact plate 5, actuate the clamping bolt 2 to displace the same vertically and clamp the lead connected to the lower contact plate 5 between the two contact plates.

In a modified embodiment of the invention the surfaces of contact plates 5 and 6, facing the printed circuit board, can be provided with arresting or locking cams 15 whereas respective locking recesses 16 be provided in the printed circuit board. Thereby a holding capability of the preassembly would not be increased.

Figure 2:
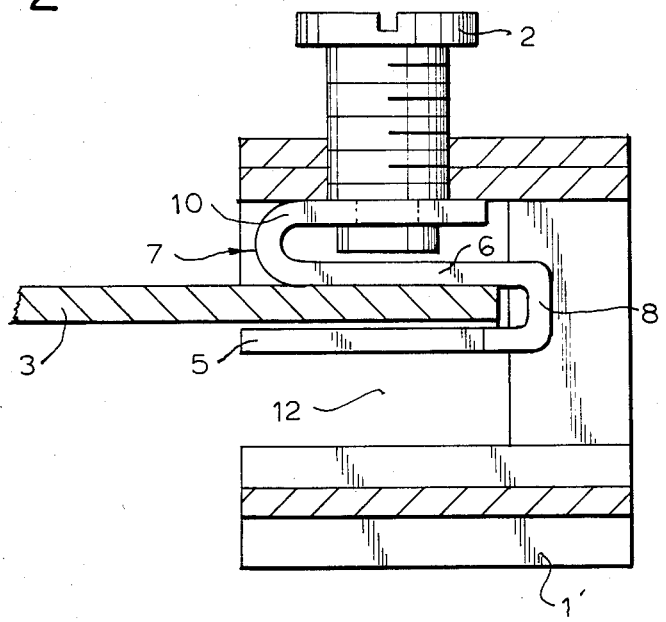
FIG. 2 is a sectional view of the connector according to a further embodiment of the invention.
Figure 3:
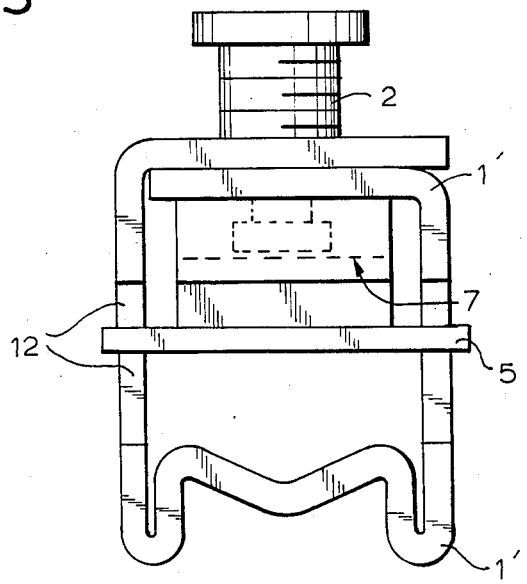
FIG. 3 is a front view of the connector of FIG. 2.

In the embodiment illustrated in FIGS. 2 and 3 the pressure element 7 which has substantially the same construction as that of FIG. 1 is freely rotationally connected with the clamping bolt 2 and is provided with two parallel contact plates 5 and 6 connected to each other by the connection cross-piece 8. The pressure element 7, the contact plates 5 and 6 of which engage in assembly the printed circuit board 3, is arranged in a pulling clamp or yoke 1' which additionally has on the side thereof facing the printed circuit board 3, a receiving slot or recess 12 so that the insertion of the connector onto the printed circuit board is no longer dependent on the fact whether the slots are provided at a respective location in the printed circuit board. The bottom wall of yoke 1' can be bent to increase stability of the yoke.

Figure 4:
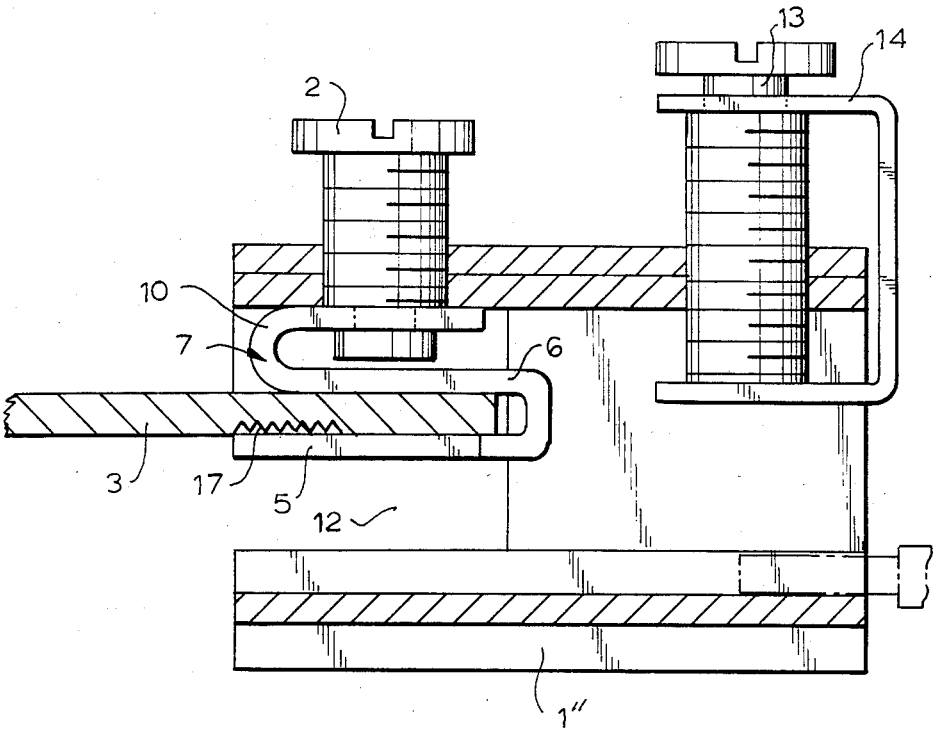
FIG. 4 is a sectional view of the connector of yet another modified embodiment of the invention.

FIG. 4 illustrates yet another embodiment of the invention in which pulling clamp or yoke 1'' is provided with a recess 12 similarly to the embodiment of FIGS. 2 and 3 to enable the traction yoke to be mounted onto the edge of the non-slotted printed circuit board. The pressure element 7 in this embodiment also has two contact plates 5 and 6 which in the inserted position of the yoke engage the electrical paths on the upper and lower surface of the printed circuit board, and a connection piece or portion 10 and is connected with a free rotation with the clamping bolt 2. In this embodiment, however, the clamping bolt 2 serves not only for connecting a lead to the yoke 1'' but also at the same time for fastening of the connector to the printed circuit board 3. Clamp or yoke 1'' has, outside the region receiving the pressure element 7, a further clamping bolt 13 which carries a clamping yoke 14 so that a lead or conductor to be connected to the board is clamped by yoke 14 and bolt 13 at the back region of the yoke whereas the connector can be finally clamped to the printed circuit board by the clamping bolt 2, the end of which would press, against the pressure element 7.

In yet another modified embodiment of the electric connector the contact plates 5 and 6 of the pressure element can be provided at their sides facing the printed circuit board with locking teeth which, upon pulling of the yoke on the printed circuit board, produce in the board respective grooves so as to provide good contact.

It will be understood that each of the elements described above, or two or more together, may also find a useful application in other types of electric connectors differing from the types described above.

While the invention has been illustrated and described as embodied in an electric connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A connector for coated printed circuit boards, comprising a traction yoke; two contact plates positioned in said yoke; a connection plate-like portion connected with an upper one of said contact plates and located thereabove; and a clamping bolt; said contact plates with said connection portion being mechanically and electrically connected to each other so as to form a single unitary contact piece, said contact plates being arranged so that a printed circuit board is engageable at its edge between said plates and a lead can be inserted between a lower one of said contact plates and a bottom wall of said traction yoke, and said clamping bolt being rotatable so that during its rotation it is rotatably held in said connection portion of said contact piece, is supported on an upper contact plate of said contact piece, and draws said traction yoke towards said lower contact plate of said contact piece whereby said lead is clamped between said bottom wall of said yoke and said lower contact plate of said contact piece while said printed circuit board is clamped between said upper and lower contact plates of said contact piece.

2. The connector as defined in claim 1, wherein a printed circuit board is non-slotted at said edge, said yoke having at a side thereof facing said edge a recess which receives said contact piece.

3. The connector as defined in claim 1, wherein said contact plates are connected to each other by a cross-piece.

4. The connector as defined in claim 2, wherein said contact plates are connected to each other by a cross-piece.

5. The connector as defined in claim 3, wherein said contact piece is made of a stamped-out and bent piece.

6. The connector as defined in claim 1, wherein said clamping bolt has a circular recess, at which the clamping bolt is connected to said connection portion of the contact piece, said bolt being rotatable relative to said connection portion of said contact piece at said recess.

7. The connector as defined in claim 1, wherein said connection portion is formed with a locking recess receiving said clamping bolt.

8. The connector as defined in claim 7, wherein said contact piece is a stamped element, said connection portion being bent over from a free outer edge of said upper plate.

9. The connector as defined in claim 8, wherein said locking recess is elongated and its elongation is directed at an angle of 90° relative to a direction of insertion of the contact plates on the printed circuit board.

10. The connector as defined in claim 3, further including an additional connecting means provided in said yoke for connecting a conductor thereto.

11. The connector as defined in claim 3, wherein said contact plates are parallel to each other and spaced from each other by a distance, said distance and the material of said contact piece being selected so that the contact piece is resiliently clamped on said printed circuit board at a predetermined position.

12. The connector as defined in claim 11, wherein said contact plates have sides facing said printed circuit board in an inserted position, said sides being formed with locking cams, said board having arresting recesses receiving said cams in said inserted position.

13. The connector as defined in claim 11, wherein said contact plates have sides facing said printed circuit board in an inserted position, said sides having locking teeth which produce grooves in said board in said inserted position.

* * * * *